United States Patent [19]

Struckmeyer

[11] Patent Number: 4,592,168

[45] Date of Patent: Jun. 3, 1986

[54] SLIDING AND PIVOTAL WINDOW

[76] Inventor: Ernest F. Struckmeyer, 1261 S. Mayfair, Daly City, Calif. 94015

[21] Appl. No.: 630,428

[22] Filed: Jul. 12, 1984

[51] Int. Cl.[4] ..... E05D 15/22

[52] U.S. Cl. ..... 49/177; 49/316; 49/174

[58] Field of Search ..... 49/177, 174, 256, 414, 49/417, 418, 453, 454, 172, 190, 194, 316, 455

[56] References Cited

U.S. PATENT DOCUMENTS 2,775,004 12/1956 Fuller ..... 49/417
3,188,699 6/1965 Walters ..... 49/177 X
3,745,708 7/1973 Gulistan ..... 49/454
4,337,597 7/1982 Struckmeyer ..... 49/174 X

*Primary Examiner*—Kenneth Downey
*Attorney, Agent, or Firm*—Harvey B. Jacobson

[57] ABSTRACT

A sliding window structure has a facility for swiveling a sliding window element about a vertical axis for cleaning purposes and the like. The window element may be released from top and bottom confining tracks to allow for pivoting thereof by lowering the bottom track using adjustment screws provided for this purpose. The window element is pivotally suspended from the top track by a pivot pin threaded into a roller carriage received in the top track.

6 Claims, 3 Drawing Figures

10
2
44
18
44
52'
52
14
12
22
24
26
27
70
70
2
20
16

44
48
44
18
48
16
36
52
38
40
42
56
30
31
57
54
56
32
55
57
12
14
26
27
10
68
28
66
60
29
58
34
62
64
16
70
72
20

48
46
50
48
48
44
48

SLIDING AND PIVOTAL WINDOW

BACKGROUND OF THE INVENTION

This invention relates to window structures of the type in which a window element slides along a support frame between open and closed positions and which also provides the facility for pivoting the window element in the support frame, e.g. for cleaning purposes. The invention is an improvement in or modification to the invention disclosed in applicant's prior U.S. Pat. No. 4,337,597, the disclosure of which is incorporated herein by reference in its entirety.

In accordance with the patented structure, a sliding window element is located, top and bottom, in channel-like tracks in a surrounding frame, the tracks constraining the window element for lengthwise sliding movement along the frame. The top track is fixed and has a lengthwise slot through which a headed stud extending upwardly from the window element projects, with the head of the stud being confined in a space above the slot. The bottom track can be raised and lowered in the frame by cam devices at opposite ends of the track. When the bottom track is raised, the window element is confined by the tracks for lengthwise sliding. However, when the cam devices are operated to lower the bottom rack, the window element is also lowered, and freed by the tracks for rotation about the headed stud which is retained by the slot in the top track. When the window element is realigned with the tracks, the bottom track can again be raised, reconfining the window element in the tracks to lengthwise sliding.

For a window structure of the above type, the present invention provides an alternative form of raising and lowering mechanism for the bottom track, and an alternative suspension assembly between the window element and the top track.

SUMMARY OF THE INVENTION

In one aspect of the invention, a simplified mechanism for raising and lowering the bottom track of a window structure of the kind referred to comprises a screw arrangement in which an adjustment screw is threaded through the bottom track from above so that the base of the screw seats on a bottom element of the surrounding window frame, whereby rotation of the screw is effective to adjust the height of the track above the bottom element of the frame. Generally, in a window structure in accordance with the invention, there will be at least two of the screw devices spaced along the length of the bottom track to replace the cam mechanisms disclosed in connection with the prior patent.

In another aspect of the invention, in place of the headed stud extending from the top of the window element through the slot in the top track, there is provided an upwardly projecting pin which is threaded into a roller carriage received in the top track in a space above the slot. When the bottom track is lowered, the carriage serves to suspend the window element for pivotal movement by rotation of the pin in the carriage.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFFERED EMBODIMENT

Figure 1:
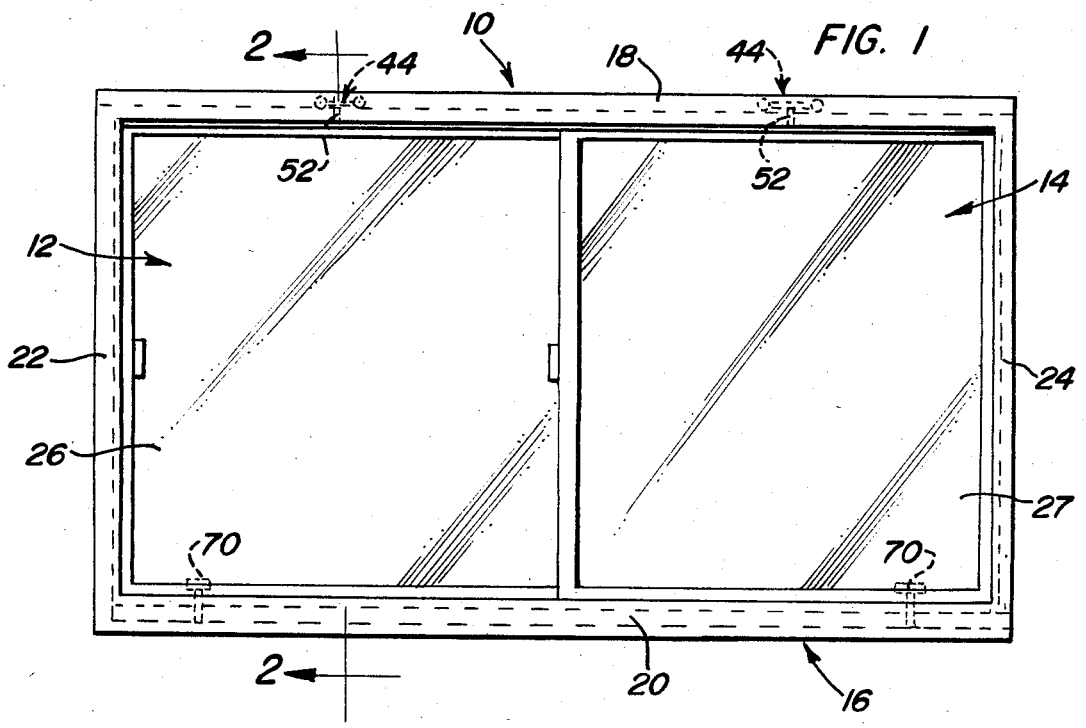
FIG. 1 is an elevational view of a window structure in accordance with the invention.
Figure 2:
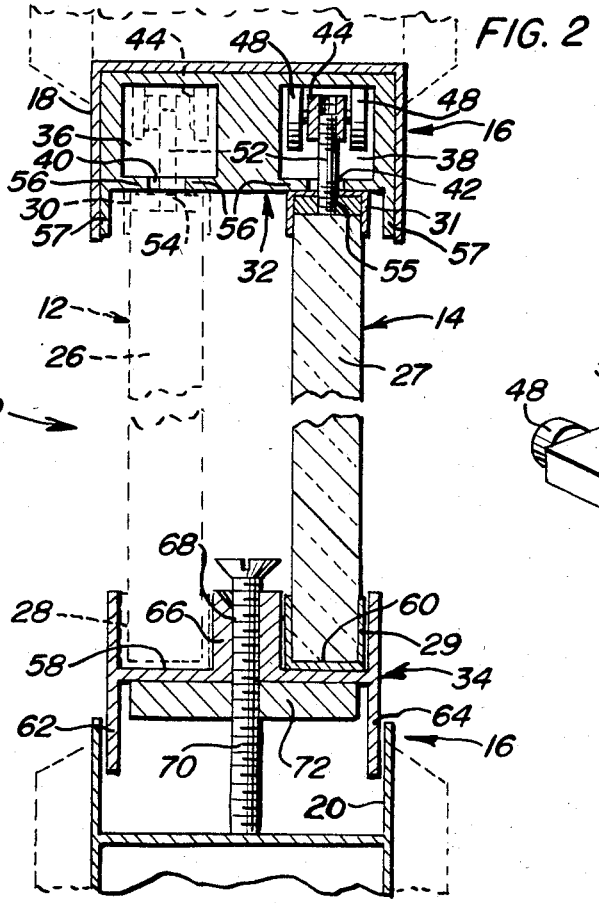
FIG. 2 is an enlarged sectional view on line 2—2 of FIG. 1.

A sliding window structure generally indicated at 10 comprises a pair of window elements 12, 14 each of which can slide horizontally along a support frame 16 which may, for example, be mounted in a wall indicated in phanton in FIG. 2. The support frame has upper and lower horizontal channel-shaped elements 18, 20 and vertical connecting elements 22, 24, all of which may be metal extrusions or the like.

Window elements 12 and 14 may each comprise a glass or like pane 26, 27 with upper and lower metal edging beads or caps 28, 29, 30, 31 and the window elements are confined for side-by-side horizontal sliding in the support frame by elongate top and bottom track members 32, 34. Top track member 32 may be suitably secured in the support frame in known manner by screws or the like (not shown) but bottom track member 34 is mounted, as will be described, for vertical adjusting movement in the support frame.

Figure 3:
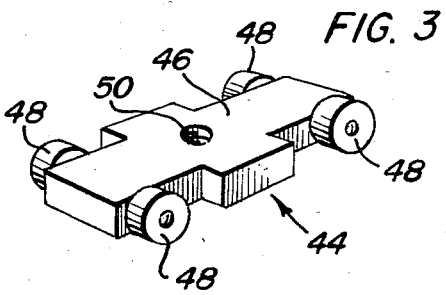
FIG. 3 is a perspective view of a window element suspension carriage used in the structure.

Top track member 32 may comprise a metal extrusion having a pair of box-like spaces 36, 38 defining lengthwise slots 40, 42. Received in each space 36, 38 is a suspension carriage 44 for the respective window element, each carriage comprising a body portion 46 with Nylon or like rollers 48 at the corners and a central tapped hole 50 (See FIG. 3). The window elements are suspended from the respective carriages by threaded pins 52 received in the tapped holes 50 and in corresponding tapped holes 54, 55 in the upper edging beads 30, 31, the pins and holes being located centrally along the length of the respective window element. The threaded pins extend through slots 40, 42 and the carriage rollers are spaced for engagement on flanges 56 of the track member defining the respective slots.

Bottom track member 34 may also comprise a metal extrusion shaped to define side-by-side channels 58, 60 for confining and guiding the lower edges of the respective window elements. The extrusion has depending outer flanges 62, 64 and near its opposite ends is formed with tapped holes 68 through central bead 66 for receiving adjustment screws 70. The screws also extend through a stiffening block 72. It will be understood that screws 70 are of a length to support track members 34 above the lower support frame element 20 with the base of each screw resting on element 20, and further that rotation of the screws serves thereby to adjust the height of track member 34. Access to screws 70 can be obtained by sliding the window elements to appropriate positions along the frame to expose the screw heads.

In normal use of the window, screws 70 are adjusted to the position shown in FIG. 2, so that the lower edge of each window element is received in, and confined for longitudinal sliding along the respective channels 58, 60 of the bottom track member. When, however, it is desired to swivel the window elements about the vertical axes defined by the pins 52, screws 70 are rotated anticlockwise to lower the bottom track member toward frame member 20. This also serves to lower the window elements from the position shown in FIG. 2 to a position in which carriage rollers 48 engage flanges 56, so that the upper edges of window elements clear outer flanges 57 of the top track member. The bottom track member is lowered until the lower edges of the window elements clear the tops of channels 58, 60 and the window elements are then freely suspended on carriages 44 for vertical swivelling movements. In order to revert to sliding operation of the window structure, the above procedure is reversed.

It will be understood from the foregoing that the invention provides a sliding window structure with simple and economical means for enabling the window elements to be swivelled about vertical axes for cleaning or like purposes. During sliding of the window elements, the carriages 44 may be in rolling contact with top walls of track member 32 as shown in FIG. 2.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A sliding window structure comprising at least one window element mounted in a support frame having top and bottom track members, at least one of which track members includes elongate guide means for receiving the window element and guiding same for lengthwise sliding along the frame, wherein said one track member includes screw adjustment means for moving the track member toward and away from an adjacent horizontal support frame member between positions wherein the guide means respectively receives the window element for guided sliding movement along the frame and releases the window element for swivelling movement of the window element in the frame about an axis perpendicular to the direction of the sliding of the window element, wherein the track member is the bottom track member, wherein the structure includes suspension means between the window element and the top track member for accommodating the longitudinal sliding and swivelling movements of the window element, and wherein the suspension means comprises a pivot pin extending from the window element through a lengthwise slot in the top track member, and a roller carriage received in a space in the top track member above the slot, the pin being rotatably connected to the roller carriage and the carriage having pairs of rollers on opposite sides of the pin for engagement with laterally spaced flanges of the top track member defining the slot.

2. The invention of claim 1 wherein the screw adjustment means comprises adjustment screws threaded through respective tapped holes in the track member with the base of each screw engaging said adjacent horizontal support frame member.

3. The invention of claim 1 wherein the pin has a threaded connection with the roller carriage.

4. A sliding window structure comprising at least one window element mounted in a support frame having top and bottom track members, at least one of which track members includes elongate guide means for receiving the window element and guiding same for lengthwise sliding along the frame, and adjustment means for moving the track member toward and away from an adjacent horizontal support frame member between positions wherein the guide means receives the window element for guided sliding movement along the frame and releases the window element for swivelling movement about an axis perpendicular to the direction of sliding movement of the window element, and suspension means between the window element and the top track member for accommodating the longitudinal sliding and swivelling movements of the window element, the suspension means comprising a pivot pin extending from the window element through a lengthwise slot in the top track member, and a roller carriage received in a space in the top track member above the slot, the pin being rotatably connected to the roller carriage and the roller carriage having rollers spaced laterally on opposite sides of the pin for engagement with laterally spaced flanges of the top track defining the slot.

5. The invention of claim 4 wherein the pin has a threaded connection with the roller carriage.

6. The invention of claim 4 wherein the adjustment means comprises adjustment screws threaded through respective tapped holes in the bottom track member with the bases of the screws engaging a lower horizontal member of the support frame.

* * * * *